United States Patent [19]

Lipp

[11] 4,336,965

[45] Jun. 29, 1982

[54] EXPANDABLE LEGREST FOR DENTAL CHAIRS

[75] Inventor: Herbert Lipp, Pfinztal, Fed. Rep. of Germany

[73] Assignee: Sybron Corporation, Rochester, N.Y.

[21] Appl. No.: 150,087

[22] Filed: May 15, 1980

[51] Int. Cl.[3] ..... A61G 15/00; A47C 7/50

[52] U.S. Cl. ..... 297/435; 297/75

[58] Field of Search ..... 297/430, 433, 434, 435, 297/75, 76

[56] References Cited

U.S. PATENT DOCUMENTS

| | | | |
|---|---|---|---|
| 156,004 | 10/1874 | Wayland | 297/434 |
| 161,887 | 4/1875 | Lambert | 297/430 |
| 1,553,689 | 9/1925 | Hill | 297/435 X |
| 2,481,970 | 9/1949 | Bell | 297/430 X |
| 2,918,964 | 12/1959 | Braun | 297/434 |
| 3,851,870 | 12/1974 | Cook | 297/430 X |
| 3,934,929 | 1/1976 | Rabinowitz | 297/75 |

*Primary Examiner*—Robert Mackey

*Attorney, Agent, or Firm*—Theodore B. Roessel; Roger Aceto

[57] ABSTRACT

A legrest for a dental chair has a telescopically nested section. A cable and pulley system automatically extends the nested section from the legrest as the legrest is moved from a generally vertical position to a generally horizontal position. Bias springs return the section to its nested position as the legrest moves back towards its near vertical position.

4 Claims, 6 Drawing Figures

EXPANDABLE LEGREST FOR DENTAL CHAIRS

BACKGROUND OF THE INVENTION

The present invention relates to dental chairs and more particularly to an expandable legrest for a dental chair.

A conventional dental chair often includes adjustable seatrest, backrest and legrest sections. With such an arrangement, the chair sections can be moved so as to accommodate either a seated or a reclining patient. In this respect, the back and legrest sections would be substantially vertically oriented for the seated patient and horizontally oriented to accommodate a reclining patient.

A patient who is seated upright in a dental chair will find that his legs overhang the legrest as the legrest and backrest are moved to the horizontal position. The reason for this is that the pivot of the legrest does not coincide with the knee joint which is the pivoting point for the patient's leg. Accordingly, as the legrest pivots from the vertical to the horizontal position, it travels through a shorter arc length than the patient's leg resulting in the patient's foot overhanging the legrest when the legrest is horizontal. This is shown schematically for example in FIG. 1 of the drawings.

One way in which the prior art overcame this problem was to eliminate the legrest and simply provide a lounge type of chair, wherein the legrest is an extension of the seatrest. Another way is to pivot a relatively long legrest section to the seat of the chair. However, in this case, the legrest cannot be moved to a near vertical position because it will hit the floor surface when the chair is moved to a low position.

In the present invention, the legrest has telescoping sections which elongate as the legrest is moved from a vertical position, accommodating the seated patient, to a horizontal position, accommodating a reclining patient. Conversely, as the chair moves from a reclining to an upright position, the telescoping legrest shortens. The elongation and the shortening of the legrest occurs automatically and in direct proportion to the inclination of the legrest.

SUMMARY OF THE INVENTION

The present invention is a legrest for a dental chair which is pivotally connected to one end of the seat frame of the chair. A drive motor acting between the seatrest and the legrest operates to rotate the legrest to any selected inclined position between generally vertical and horizontal limits of travel. Telescopically nested within the legrest is an extension. This extension automatically telescopes out of the legrest to increase length as the legrest moves to the horizontal position and automatically retracts into the legrest to shorten length as the legrest moves to the vertical position. Movement of the extension is automatic and in direct proportion to the inclination of the legrest between its vertical and horizontal limits. The means for operating the extension is a cable and pulley system designed to pull the extension outwardly against the bias of a return spring.

DESCRIPTION OF THE PREFERRED EMBODIMENTS

Figure 1:
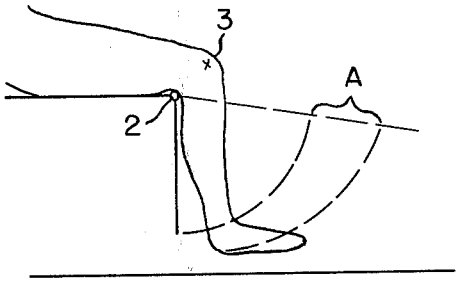
FIG. 1 schematically shows the operation of the legrest of a dental chair without length compensation of the legrest.

FIG. 1 illustrates the problem to be solved by the present invention wherein the reference numerals 2 and 3 correspond to the pivot point of the legrest and the knee of the patient, respectively. It is apparent from this figure that the pivot point of the legrest does not coincide with the pivot point of the patient's leg. For this reason, the patient's leg will overhang the end of the legrest by an amount indicated at A when the legrest has moved to its horizontal limit of travel. The present invention is designed to compensate for this and to add a length to the legrest equal at least to the distance A so as to fully support the leg of the patient when the legrest is raised to the horizontal limit of travel.

Figure 2:
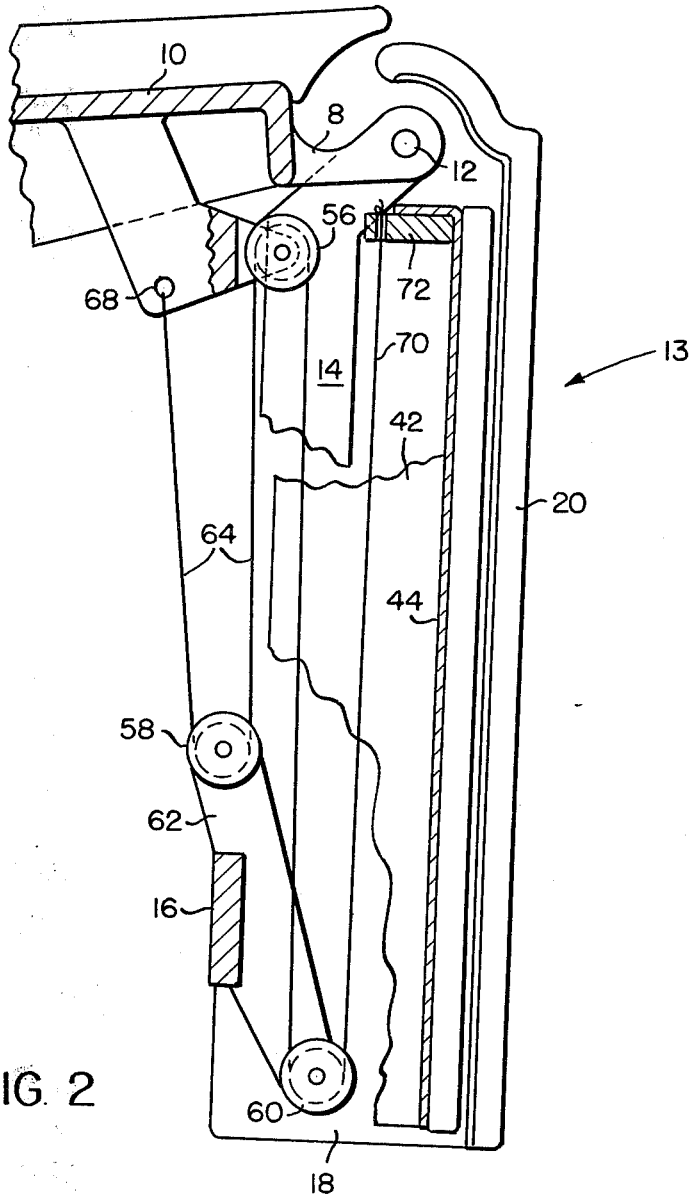
FIG. 2 is a view of the legrest of the dental chair in a folded or vertical postition taken substantially along lines 2—2 of FIG. 3.

Referring now to FIG. 2, the forward portion of the dental chair seat frame is shown at 10. Extending in a forward direction from each side of the seat frame is a bracket 8. The legrest generally indicated at 13, has a frame including two side members 14. Each side member 14 (only one of which is shown in the figures) is journaled at 12 to bracket 8 and hangs from the bracket when the chair is in the configuration to accommodate a seated patient. The legrest frame 13 is completed by a cross piece 16 which extends between the two side members 14. Various decorative paneling and upholstery 18 and 20, respectively, is attached to the legrest frame by any suitable means well-known in the art to complete the legrest.

Figure 3:
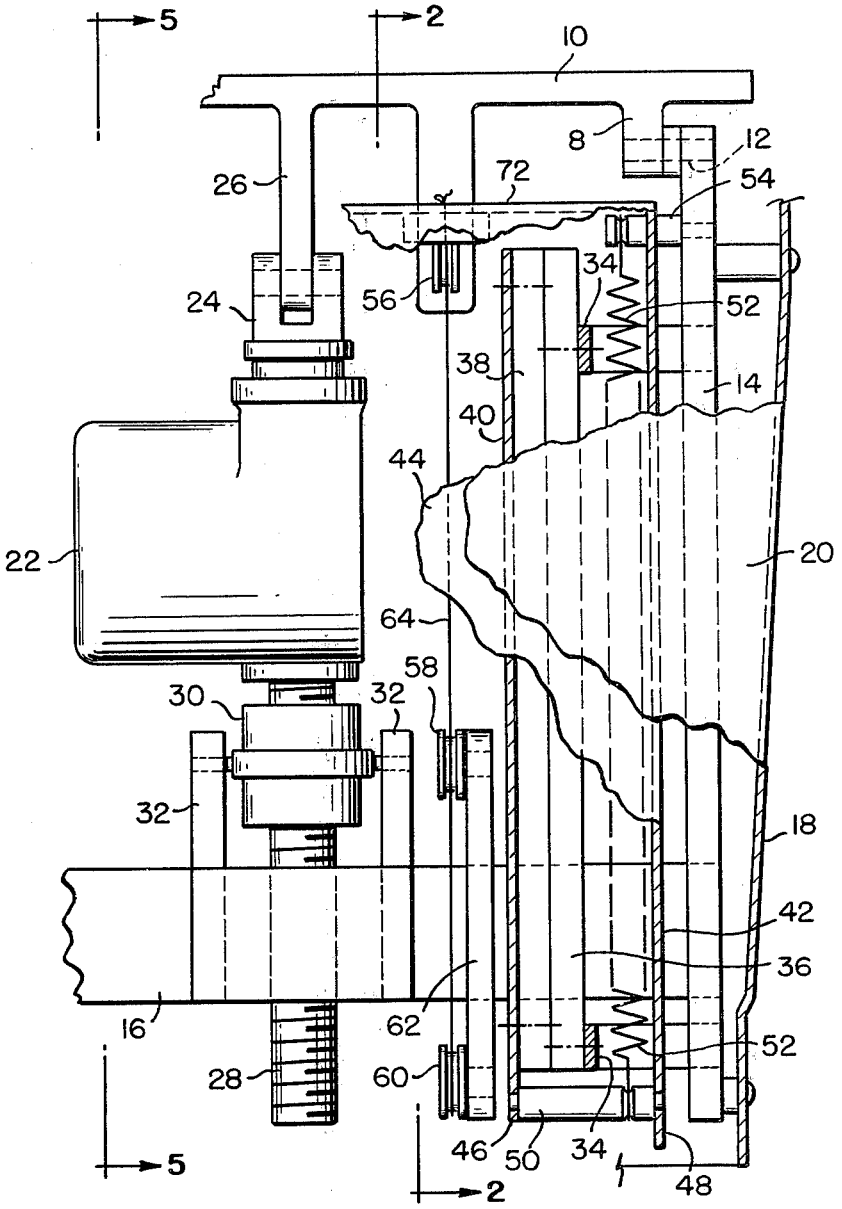
FIG. 3 is a plan view of a portion of the legrest as shown in FIG. 2 with part of the upholstery removed from both the legrest and extension to show internal components.
Figure 5:
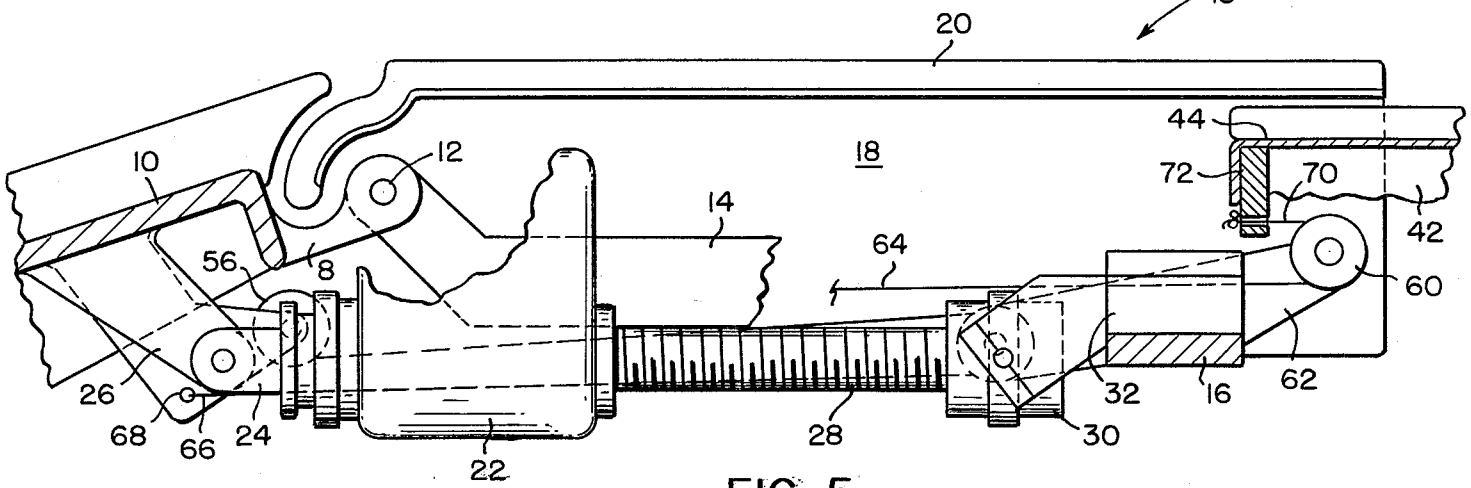
FIG. 5 is view taken generally along lines 5—5 of FIG. 3 only showing the legrest in a horizontal position.

Legrest 13 is moved between its vertical and horizontal limits of travel by a drive motor 22 (FIGS. 3 and 5). This motor has one end connected by clevis 24 to a mounting piece 26 of the seat frame. Drive motor 22 turns a lead screw 28, which in turn drives a slave nut 30. The slave nut pushes on the cross piece 16 of the legrest frame through a pair of brackets 32 which are attached to and extend from the cross piece 16. With this arrangement, movement of the slave nut along the screw from its position shown in FIG. 3 to the end of the screw as shown in FIG. 5 will rotate the legrest about bracket 8 and bring the legrest to its horizontal limit to travel as shown in FIG. 5.

Figure 4:
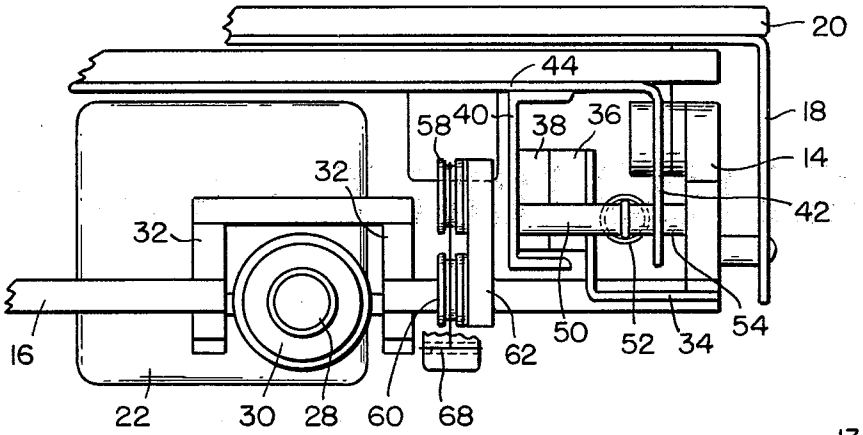
FIG. 4 is a end view of the legrest in the position shown in FIG. 2.

Fixed to and extending inward from each side member 14 of the legrest frame are spaced support brackets 34, one located adjacent each end of the side member (FIGS. 3 and 4). Fixed to and extending between support brackets 34 is the fixed guide track 36 of a slide mechanism. The runner, or moving portion of the slide mechanism is shown at 38. The slide mechanism is a design well known in the art and it is sufficient for purposes of this invention only to say that the runner or moving portion 38 is captured in the guide track and can travel along the track.

Runner 38 forms part of the legrest extension. The extension is normally telescopically nested within the legrest 13 when the legrest is at its vertical limit of travel as shown in FIGS. 2 and 3. The extension is formed by inner and outer side panels 40, 42 respectively, and a top 44. The inner panel 40 is fixed to and runs generally the full length of the runner 38. The forward end 46 of the inner side panel 40 extends in front of the runner 38 as best shown in FIG. 3. As shown in FIG. 4, this side panel 40 extends upwardly and attaches to the top 44 of the extension. The outer side panel 42 of the extension is also attached to top 44, and runs generally parallel to the inner panel 40.

Fixed to and extending between the front ends 46, 48 of the inner and outer side panels is a cross pin 50. Fixed to the cross pin 50 is one end of an expansion spring 52. The other end of the spring is attached to a pin 54 carried by the side member 14 of the legrest frame. Spring 54 tends to pull the legrest extension to a telescopically nested position within the legrest as is shown, for example, in FIGS. 2 and 3.

The mechanism for extending the legrest extension is a cable and pulley system which will be described with reference to FIGS. 2–4.

The pulley and cable system include three pulleys, the first pulley 56 journaled to the seatrest frame and two pulleys 58, 60 journaled to a bracket 62 carried by cross piece 16. The cable 64 of the system has one end 66 tied to the seatrest frame at a point 68 spaced below and rearward from the journal 12 of side member 14 to seat frame bracket 8. The cable extends first around pulley 58 then back over pulley 56, forward again and over pulley 60 and then back toward the seat frame with the second end 70 of the cable being attached to the rear end wall 72 of the legrest extension. Thus, pulley 56 which is fixed to the seat frame occupies a position in the pulley and cable system which is between the two pulleys 58, 60 on the legrest. This forms a double tackle block for purposes set out hereinbelow.

Figure 6:
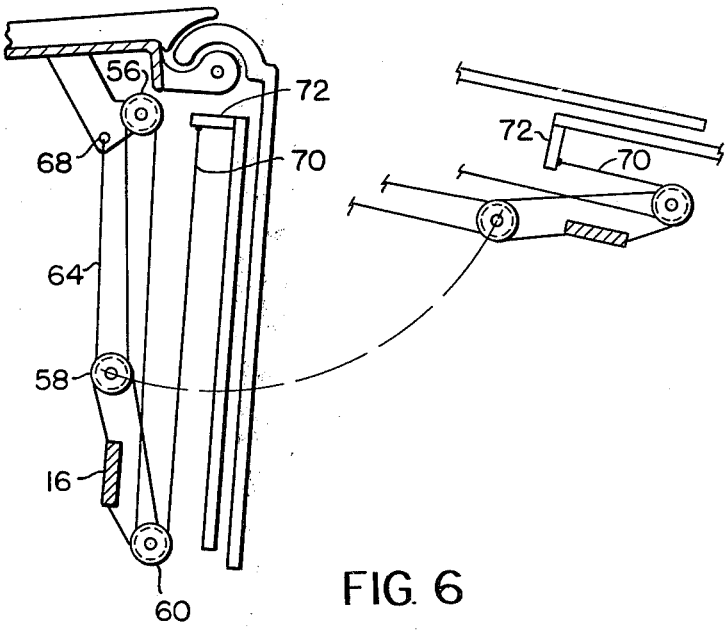
FIG. 6 is a schematic view showing the operation of the legrest extension as it moves between its vertical and horizontal limits of travel.

In operation, motor 22 is activated to pivot the legrest from the vertical limit of travel as shown in FIG. 2 to the horizontal limit of travel as shown in FIG. 5. In this respect, the travel of slave nut 30 along screw 28 pushes against bracket 32 and cross piece 16 to pivot side members 14 of the legrest about pivot 12. Pulley 58 is carried by the legrest frame so it also pivots about journal 12. This causes pulley 58 to travel away from the cable attachment point 68 (FIG. 6). Since cable 64 is a fixed length, the increased distance of pulley 58 from the cable attachment point 68 is accommodated by moving or pulling cable end 70 towards the front of the legrest frame. This end 70 of the cable is attached to the rear wall 72 of the legrest extension so pulling the cable likewise moves the extension from its telescopically nested position against the bias of spring 52.

As described hereinabove, there are two pulleys 58, 60 attached to the legrest and one pulley 56 attached to the seatrest frame which forms a double tackle block. Accordingly, there are four cable sections which increase in length and must be accommodated for by movement of the cable end 70. With this arrangement, cable end 70 must travel substantially the full length of the legrest so that the telescopically nested extension is fully extended as shown in FIGS. 5 and 6 when the legrest has been pivoted to its vertical limit of travel. Thus, the overall length of the legrest frame is increased to compensate for the problem illustrated by FIG. 1 and described hereinabove.

As the legrest frame returns to its vertical limit of travel, spring 52 pulls the extension back to its telescopically nested position. Thus, the extension gradually moves to or from its telescopically nested position depending upon the movement of the legrest frame. As the inclination of the legrest frame increases as it moves toward its horizontal limit of travel, the length of the extension increases by an amount directly proportional to the inclination of the legrest.

Thus, it should be appreciated that the legrest of the present invention automatically elongates or shortens the overall length of the legrest as it moves between its vertical and horizontal limits of travel. In this manner, the legs of the patient seated in the dental chair are fully supported at all times as the patient moves from a upright to a reclined position.

I claim:

1. In a dental chair including a seat frame, a legrest pivotally connected to the forward end of the seat frame, a drive for moving the legrest about the pivot between generally vertical and horizontal limits of travel, an extension telescopically nested within the legrest and a cable and pulley system for moving the extension from its nested position as the legrest moves to its horizontal limit of travel, the improvement comprising:

(a) said pulley and cable system is a double block and tackle including
  (i) a first pulley (56) journaled to the seat frame beneath and rearward of the pivot connection of the legrest to the seat frame,
  (ii) second and third pulleys (58, 60) journaled to the legrest, and
  (iii) a cable (64) passing over said pulleys, one end of said cable being fixed to the seat frame adjacent said first pulley and the other end of said cable being fixed to the rear of the extension, the path of said cable being such that said first pulley occupies a position in the cable and pulley system which is intermediate said second and third pulleys;

(b) said drive includes a motor (22) and a driven member (28, 30), said motor being pivotally connected at one end (24) to the seat frame beneath and rearward of the pivot connection of the legrest to the seat frame and said driven member being operatively connected to said motor and the legrest so that said motor and driven member both move between vertical and horizontal limits of travel when said motor is operated to raise and lower the legrest; and (c) bias means acting between the legrest and extension for urging said extension to its telescopically nested position.

2. A dental chair as in claim 1 in which:

(a) the legrest has a top and depending sides;

(b) said extension includes
  (i) a top panel (44), and
  (ii) inner and outer side panels (40, 42) depending from said top panel, said inner and outer panels being parallel and defining a space therebetween;

(c) front and rear support brackets (34) carried by the legrest and extending inward from a side thereof, said support brackets extending below said outer side panel (42) and upwardly into the space between said inner and outer side panels; and (d) cooperating slide members (36, 38) on said bracket and inner side panel for slidably supporting the extension within the legrest.

3. A dental chair as in claim 2 in which said slide members include a track (36) fixed to said brackets and a runner (38) fixed to said inner side panel for movement along said track.

4. A dental chair as in claim 2 including:

(a) a first pin extending between and fixed to said inner and outer side panels;

(b) a second pin fixed to the legrest adjacent the pivot connection of the legrest to the seatrest; and (c) said bias means extending between said pins for normally urging the extension into a telescopically nested position.

* * * * *